US007888580B2

(12) United States Patent
Okano et al.

(10) Patent No.: US 7,888,580 B2
(45) Date of Patent: Feb. 15, 2011

(54) ELECTRONIC MUSICAL SYSTEM AND CONTROL METHOD FOR CONTROLLING AN ELECTRONIC MUSICAL APPARATUS OF THE SYSTEM

(75) Inventors: Tadashi Okano, Hamamatsu (JP); Toru Kitayama, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 186 days.

(21) Appl. No.: 12/329,366

(22) Filed: Dec. 5, 2008

(65) Prior Publication Data

US 2009/0145283 A1 Jun. 11, 2009

(30) Foreign Application Priority Data

Dec. 7, 2007 (JP) ..... 2007-317167

(51) Int. Cl.
*G10H 1/00* (2006.01)

(52) U.S. Cl. ..... 84/615; 84/653; 84/600

(58) Field of Classification Search ..... 84/600–602, 84/615, 653
See application file for complete search history.

(56) References Cited

U.S. PATENT DOCUMENTS

| | | | | |
|---|---|---|---|---|
| 6,653,545 | B2 * | 11/2003 | Redmann et al. | 84/615 |
| 7,531,737 | B2 * | 5/2009 | Ide et al. | 84/645 |
| 7,620,468 | B2 * | 11/2009 | Shimizu | 700/94 |
| 2005/0038922 | A1 * | 2/2005 | Yamamoto et al. | 710/1 |
| 2005/0155484 | A1 * | 7/2005 | Yanase et al. | 84/615 |
| 2005/0159832 | A1 * | 7/2005 | Umeo et al. | 700/94 |
| 2006/0248173 | A1 * | 11/2006 | Shimizu | 709/220 |
| 2009/0133567 | A1 * | 5/2009 | Okano et al. | 84/609 |
| 2009/0145283 | A1 * | 6/2009 | Okano et al. | 84/609 |
| 2009/0145287 | A1 * | 6/2009 | Okano | 84/645 |
| 2009/0177304 | A1 * | 7/2009 | Shimizu | 700/94 |
| 2009/0234479 | A1 * | 9/2009 | Shimizu | 700/94 |
| 2009/0301289 | A1 * | 12/2009 | Gynes | 84/645 |
| 2009/0307395 | A1 * | 12/2009 | Umeo et al. | 710/61 |

OTHER PUBLICATIONS

The Best Reference Books Cubase SX/SL 2X for Windows (registered trademark) 2000/XP Comprehensive Operation Guide, by Ken Fujimoto and Tomoki Ohtubo, published Jul. 31, 2004, vol. 1, from Rittor Music, Inc.
Motif ES Owner's Manual, Music Production Synthesizer, Yamaha Corporation, 2003.

* cited by examiner

*Primary Examiner*—David S. Warren
(74) *Attorney, Agent, or Firm*—Morrison & Foerster LLP

(57) ABSTRACT

An electronic musical system in which tone generator parameters of each of tone generators respectively assigned to tracks of a sequencer of an electronic musical apparatus can easily be controlled by using a musical control apparatus, while tracks are switched. In the setting of the tone generator parameters of the tone generators assigned to the tracks, setting contents are input by using control operating elements of the musical control apparatus. There are prepared in advance templates in each of which control operating elements are made to correspond to tone generator parameters controlled by the control operating elements, and each tone generator is made in one-to-one correspondence with one of the templates, whereby tone generator parameters of a tone generator assigned to a track currently designated by a user are set by manipulating the control operating elements of the musical control apparatus.

11 Claims, 9 Drawing Sheets

ELECTRONIC MUSICAL SYSTEM AND CONTROL METHOD FOR CONTROLLING AN ELECTRONIC MUSICAL APPARATUS OF THE SYSTEM

BACKGROUND OF THE INVENTION

1. Field of the Invention

The present invention relates to an electronic musical system comprised of an electronic musical apparatus having a sequencer and a musical control apparatus for remotely controlling the electronic musical apparatus, and relates to a control method for controlling the electronic musical apparatus.

2. Description of the Related Art

An electronic musical system is conventionally known that includes an electronic musical apparatus having a sequencer and a musical control apparatus for remotely controlling the electronic musical apparatus.

For example, there is known an electronic musical system comprised of an electronic musical apparatus including a PC (personal computer) on which DAW (digital audio workstation) software is installed and runs and a musical control apparatus including a physical controller such as a MIDI (musical instrument digital interface) keyboard, the system being adapted to control the DAW software by the physical controller (see, for example, MOTIF ES OWNER'S MANUAL, Yamaha Corporation). With Steinberg's Cubase (registered trademark) SX which is an example DAW software, a software tone generator selected by a user from software tone generators installed in a PC can be assigned to a track of a sequencer (see, for example, the following document).

"THE BEST REFERENCE BOOKS Cubase SX/SL 2X for Windows (registered trademark) 2000/XP Comprehensive Operation Guide", Ken Fujimoto and Tomoki Ohtubo, Jul. 31, 2004, Vol. 1, Rittor Music, Inc.

In a case that software tone generators of different types are respectively assigned to tracks of a sequencer, a user demands that tone generator parameters of the tone generators can be controlled by using a single physical controller, while the tracks are switched. With the conventional electronic musical system, however, to cope with the user's demand, the settings on a correspondence relation between operating elements of the physical controller and tone generator parameters controlled by these operating elements must be changed each time tracks are switched. This is because different types of software tone generators are usually different from one another in terms for example of names and characteristics of tone generator parameters and what tone generator parameters each generator has. Thus, the conventional system cannot meet the user's demand in practice because of the need of extreme complicated setting operations.

SUMMARY OF THE INVENTION

The present invention provides an electronic musical system and a method for controlling an electronic musical apparatus of the system, by which various tone generator parameters of tone generators respectively assigned to tracks of a sequencer of the electronic musical apparatus can easily be controlled by using the single musical control apparatus, while tracks are switched.

According to a first aspect of this invention, there is provided an electronic musical system comprised of an electronic musical apparatus and a musical control apparatus for remotely controlling the electronic musical apparatus, wherein the musical control apparatus comprises at least one operating element each adapted to vary a parameter, a receiver unit adapted to receive, from the electronic musical apparatus, tone generator type information representing a tone generator type, and a transmission unit adapted, in response to a user's manipulation on the operating element, to transmit to the electronic musical apparatus a parameter control command for controlling a tone generator parameter of the tone generator of the type represented by the tone generator type information received by the receiver unit, and the electronic musical apparatus comprises a sequencer having a plurality of tracks, tone generators of different tone generator types, a designation unit adapted to designate any one of the plurality of tracks, a setting unit adapted to set tone generator types each selected from the different tone generator types to respective ones of the tracks, a transmission unit adapted, when any one of the tracks is designated by the designation unit, to transmit to the musical control apparatus tone generator type information representing the tone generator type set by the setting unit to the designated track, a receiver unit adapted to receive the parameter control command transmitted from the musical control apparatus, and a control unit adapted to control, in accordance with the parameter control command received by the receiver unit of the electronic musical apparatus, the tone generator parameter of the tone generator of the type set to the designated track.

With the electronic musical system of this invention, when any one of the tracks of the sequencer of the electronic musical apparatus is designated, tone generator type information representing a tone generator type set to the designated track is transmitted to the musical control apparatus, and the musical control apparatus receives the tone generator type information transmitted from the electronic musical apparatus. In response to a user's manipulation on the operating element, a parameter control command for controlling the tone generator parameter of the tone generator of the type represented by the received tone generator type information is transmitted to the electronic musical apparatus. Therefore, even if the tracks are switched in sequence, the tone generator parameter of the tone generator set to each of the tracks can easily be controlled by the operating element of the musical control apparatus.

The musical control apparatus can further include a display unit adapted to display a name corresponding to the parameter control command.

In this case, the user is notified of the name corresponding to the parameter control command, i.e., the name corresponding to the tone generator parameter controlled by the operating element, thus making it possible to prevent the user from performing an erroneous manipulation on the musical control apparatus.

The operating element of the musical control apparatus can include parameter control operating elements, and the tone generators of the electronic musical apparatus can each comprise tone generator parameters, and the musical control apparatus can further include a storage unit adapted to store a plurality of templates in each of which a correspondence relation between the parameter control operating elements and the tone generator parameters of one of the tone generators is defined, the storage unit being able to be adapted to store a correspondence table in which each of at least one of the tone generators is made to correspond to any template selected from the templates stored in the storage unit, a selection unit adapted to read out from the storage unit the template which is made to correspond to the tone generator of the type represented by the tone generator type information received by said receiver unit of the musical control apparatus and select the read-out template, and a generation unit adapted to generate the parameter control command based on a user's manipulation on any one of the parameter control operating elements and the template selected by the selection unit, and the transmission unit can be adapted to transmit the parameter control command generated by the generation unit to the electronic musical apparatus.

The electronic musical apparatus can further include a correspondence table setting unit adapted to set the correspondence table in response to a user's setting operation.

In this case, the user is allowed to arbitrarily set the correspondence table between templates and tone generator types, whereby a manipulation system suited to preferences of the user can be realized.

The storage unit of the musical control apparatus can be adapted to store a default template, and the selection unit of the musical control apparatus can be adapted to read out the default template from the storage unit and select the read-out default template in a case where the tone generator of the type represented by the tone generator type information received by the receiver unit is not present in the correspondence table.

In this case, if the received tone generator type is one that cannot be recognized by the musical control apparatus, the default template is selected, whereby an occurrence of a situation in which the tone generator parameters of the tone generator become entirely uncontrollable can be avoided.

According to a second aspect of this invention, there is provided a musical control apparatus for remotely controlling an external electronic musical apparatus comprising at least one operating element each adapted to vary a parameter, a receiver unit adapted to receive tone generator type information representing a tone generator type from the electronic musical apparatus, and a transmission unit adapted, in response to a user's manipulation on the operating element, to transmit to the electronic musical apparatus a parameter control command for controlling a tone generator parameter of a tone generator of the type represented by the tone generator type information received by the receiver unit.

According to a third aspect of this invention, there is provided a control method for controlling an electronic musical apparatus including a sequencer having a plurality of tracks and tone generators of different tone generator types, the control method comprising a transmission step of transmitting to the musical control apparatus, when any one of the tracks is designated by a designation unit adapted to designate any one of the plurality of tracks, tone generator type information representing the tone generator type set to the designated track by a setting unit, which is adapted to set tone generator types selected from the different tone generator types to respective ones of the tracks, a reception step of receiving a parameter control command transmitted from the musical control apparatus, and a control step of controlling, in accordance with the parameter control command received in the reception step, the tone generator parameter of the tone generator of the type set to the designated track.

Further features of the present invention will become apparent from the following description of an exemplary embodiment with reference to the attached drawings.

DETAILED DESCRIPTION OF THE PREFERRED EMBODIMENT

The present invention will now be described in detail below with reference to the drawings showing a preferred embodiment thereof.

Figure 1:
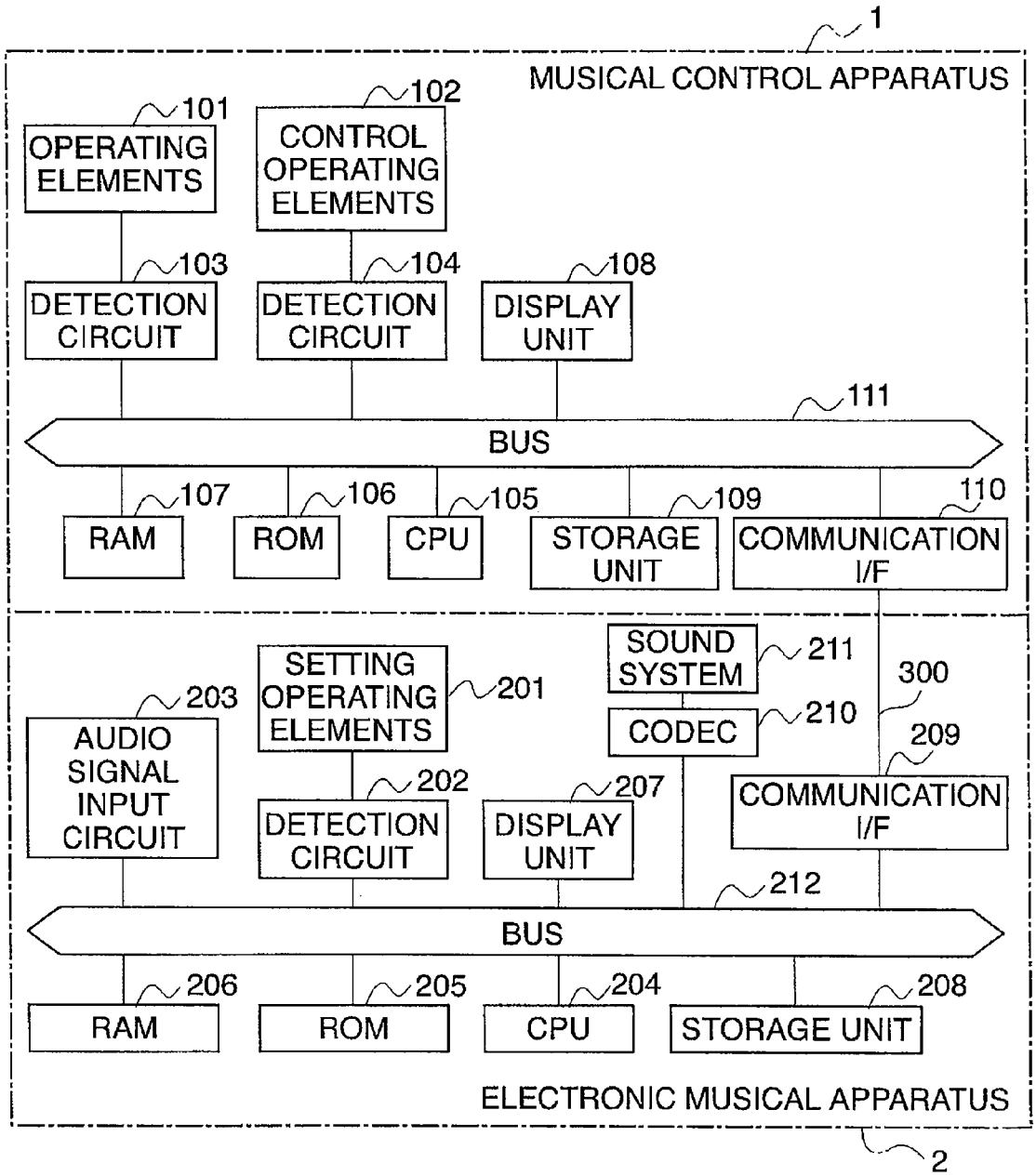
FIG. 1 is a block diagram showing the schematic construction of a musical control apparatus and an electronic musical apparatus according to one embodiment of this invention.

FIG. 1 shows in block diagram the schematic construction of an electronic musical system according to one embodiment of this invention. As shown in FIG. 1, the electronic musical system includes a musical control apparatus 1 and an electronic musical apparatus 2. As the musical control apparatus 1, a MIDI keyboard is used. As the electronic musical apparatus 2, a PC on which DAW software is installed and runs is used.

The musical control apparatus 1 is comprised of performance operating elements 101 including a keyboard for inputting performance information that includes pitch information, control operating elements 102 having knobs, sliders, switches, etc., for inputting various control information and various setting information, a detection circuit 103 for detecting operation states of the performance operating elements 101, a detection circuit 104 for detecting operation states of the control operating elements 102, a CPU 105 for controlling the entire apparatus 1, a ROM 106 for storing a control program implemented by the CPU 105, various table data, etc., a RAM 107 for temporarily storing performance information, various input information, results of computation, etc., a display unit 108 having a small-sized liquid crystal display (LCD), light emitting diodes (LEDs), etc., for displaying various information, etc., a storage unit 109 for storing various application programs including the control program, various music data, various data, etc., and a communication interface (I/F) 110 for transmitting and receiving data to and from the electronic musical apparatus 2 via a communication line 300.

The above described elements 103 to 110 are connected with one another via a bus 111, and a communication line 300 is connected to the communication I/F 110.

The storage unit 109 includes a storage medium and a drive unit therefor. The storage medium is comprised, such as for example, of a flexible disk (FD), a hard disk (HD), a CD-ROM, a DVD (digital versatile disk), an optomagnetic disk (MO), or a semiconductor memory. The storage medium may detachably be mounted to the drive unit. Alternatively, the storage unit 109 itself may detachably be mounted to the musical control apparatus 1, or both the storage medium and the storage unit 109 may detachably be mounted to the apparatus 1. As described above, the control program implemented by the CPU 105 can be stored in the storage unit 109 (specifically, the storage medium thereof). If the control program is not stored in the ROM 106, the control program is stored in the storage unit 109 and read into the RAM 107. In that case, the CPU 105 is operable in the same manner as in the case the control program is stored in the ROM 106, whereby addition and version upgrade of the control program can easily be performed.

As the communication I/F 110, there may be mentioned, for example, a wired I/F for music use only which is exclusively used for transmission and reception of music signals such as MIDI signals, a general-purpose short distance wired I/F such as USB (universal serial bus) or IEEE 1394, a general-purpose network I/F such as Ethernet (registered trademark), and a general-purpose short distance wireless I/F such as wireless LAN (local area network) or Bluetooth (registered trademark). In this embodiment, the communication I/F 110 is implemented by USB, but may be implemented by another type interface alone or in combination thereof with USB.

The musical control apparatus 1 of this embodiment is implemented by a MIDI keyboard, but this is not limitative. A musical keyboard adapted to output a musical signal of a type different from MIDI signal may be used. Instead of such a keyboard instrument, there may be used a musical instrument of another form such as a string instrument type, a wind instrument type, or a percussion instrument type. Furthermore, the musical control apparatus is not limited to being in the form of musical instrument, but may be a control table having control operating elements alone or in combination thereof with a display unit.

The electronic musical apparatus 2 includes setting operating elements 201 which include an alphanumeric input keyboard, a mouse, etc., a detection circuit 202 for detecting operation states of the setting operating elements 201, an audio signal input circuit 203 for inputting an audio signal, a CPU 204 for controlling the entire apparatus 2, a ROM 205 for storing a control program implemented by the CPU 204, various table data, etc., a RAM 206 for temporarily storing music data, various input information, computation results, etc., a display unit 207 having a liquid crystal display (LCD), light emitting diodes (LEDs), etc. for displaying various information, etc., a storage unit 208 for storing various application programs including the control program, various music data, various data, etc., a communication I/F 209 for transmitting and receiving data to and from the musical control apparatus 1 via the communication line 300, a CODEC (coder-decoder) 210 for expanding a compressed digital audio signal and converting the expanded digital audio signal into an analog audio signal, and a sound system 211 including an amplifier, a speaker, etc. for converting the audio signal from the CODEC 210 into sound.

The above described elements 202 to 210 are Connected with one another via a bus 212. The communication line 300 is connected to the communication I/F 209, and the sound system 211 is connected to the CODEC 210.

The storage unit 208 includes a storage medium and a drive unit therefor. The storage medium is comprised, such as for example, of a flexible disk (FD), a hard disk (HD), a CD-ROM, a DVD (digital versatile disk), an optomagnetic disk (MO), or a semiconductor memory. The storage medium may detachably be mounted to the drive unit. Alternatively, the storage unit 208 itself may detachably be mounted to the electronic musical apparatus 2, or both the storage medium and the storage unit 208 may detachably be mounted to the apparatus 2. As described above, the control program implemented by the CPU 204 can be stored in the storage unit 208 (specifically, the storage medium thereof). If the control program is not stored in the ROM 205, the control program is stored in the storage unit 208 and read into the RAM 206. In that case, the CPU 204 is operable in the same manner as in the case the control program is stored in the ROM 205, whereby addition and version upgrade of the control program can easily be performed.

The communication I/F 209, which is connected via the communication line 300 to the communication I/F 110, is of the same type as the communication I/F 110.

The electronic musical apparatus 2 of this embodiment is implemented by a PC on which DAW software is installed and runs, but this is not limitative. A special-purpose unit for achieving DAW may be used. As the electronic musical apparatus 2, there may be used a PC on which is installed and runs music software that falls outside the category of DAW software. As described later with reference to FIG. 2, DAW software includes all the functions of a tone generator unit 2*d*, a sequencer 2*e*, a recorder 2*g*, and a mixer 2*h*, but is not required to include all the functions of these. The DAW software may include a part of the functions. In that case, other functions may be an add-on form to be associated with DAW software as needed. Alternatively, DAW software may only have a function of exercising control over all the functions, which are present in isolation from one another. In brief, the arrangement at least includes a sequencer and tone generators.

Figure 2:
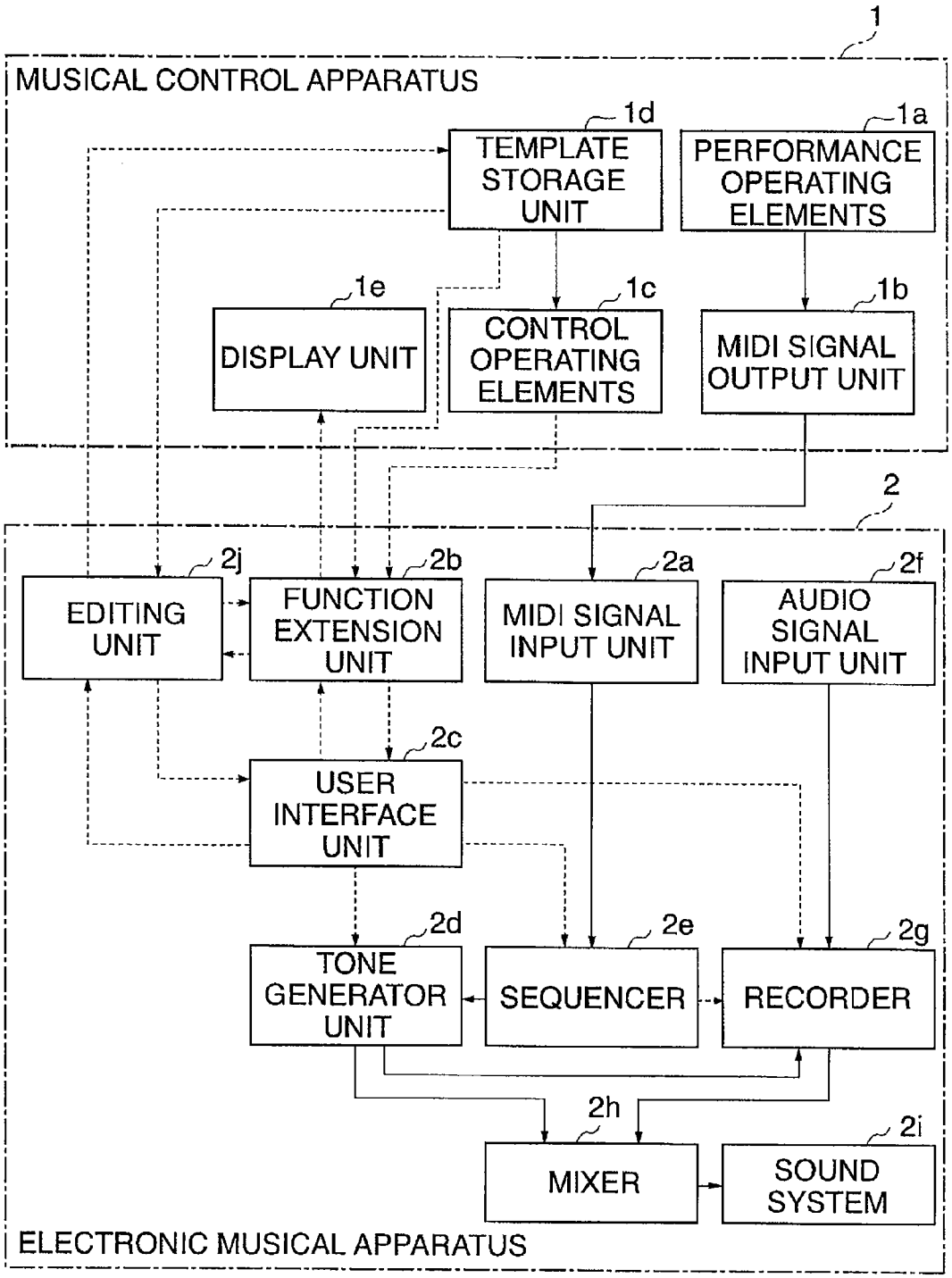
FIG. 2 is a block diagram showing the functional construction of the musical control apparatus and the electronic musical apparatus in FIG. 1.

FIG. 2 shows in block diagram the functional constructions of the musical control apparatus 1 and the electronic musical apparatus 2.

As shown in FIG. 2, signals are exchanged between the musical control apparatus 1 and the electronic musical apparatus 2. There are a plurality of blocks from each of which a signal is supplied (a MIDI signal output unit 1*b*, control operating elements 1*c*, a template storage unit 1*d*, a function extension unit 2*b*, and an editing unit 2*j*), and there are a plurality of blocks to each of which a signal is supplied (a MIDI signal input unit 2*a*, the function extension unit 2*b*, the editing unit 2*j*, the template storage unit 1*d*, and a display unit 1*e*). As shown in FIG. 1, the musical control apparatus 1 and the electronic musical apparatus 2 are connected with each other only via the communication I/F 110, the communication line 300, and the communication I/F 209. Thus, signals from the control apparatus 1 to the musical apparatus 2 and signals from the apparatus 2 to the apparatus 1 are transmitted via the common route of the communication I/F 110, the communication line 300, and the communication I/F 209. Specifically, when a signal is transmitted from the control apparatus 1 to the musical apparatus 2, the CPU 105 of the control apparatus 1 stores transmission data in a transmission buffer (not shown) of the communication I/F 110. The communication I/F 110 transmits the data stored in its transmission buffer to the communication I/F 209 in accordance with a USB protocol. The communication I/F 209 temporarily stores the received data into a receiver buffer (not shown) thereof. The CPU 204 of the musical apparatus 2 supplies the data stored in the receiver buffer of the communication I/F 209 to a block determined according to the type of the data. In this embodiment, processing to distribute data stored in the receiver buffer of the communication I/F 209 to the corresponding block is performed by the CPU 204 as described above, but this is not limitative. Each block may always monitor the receiver buffer and access the receiver buffer when data to be processed is stored therein, thereby acquiring the data stored in the receiver buffer. To transmit a signal from the musical apparatus 2 to the control apparatus 1, processing reverse to the processing for signal transmission from the apparatus 1 to the apparatus 2 may be performed, and a description thereof is therefore omitted.

Actual signal flow between the musical control apparatus 1 and the electronic musical apparatus 2 is not exactly the same as that illustrated in FIG. 2. FIG. 2 shows what signals are output from which blocks when control processes are performed by the blocks. In the following, contents of control implemented by the respective blocks will be described based on the signal flow routes shown in FIG. 2.

Performance operating elements 1*a* are equivalent to the performance operating elements 101 and the detection circuit 103 in FIG. 1. When the user manipulates any of the performance operating elements 101, a corresponding performance operating element 1*a* outputs to the MIDI signal output unit 1*b* performance operating element designation information that designates the manipulated element 101 (for example, a key number assigned to the manipulated key among key numbers assigned to respective keys of the keyboard of the performance operating elements 101) and manipulation information representing a state of manipulation (for example, key on/off information and velocity information in the case of the performance operating elements 101 being comprised of the keyboard).

The MIDI signal output unit 1*b*, which is mainly comprised of the CPU 105 and the RAM 107, is adapted to temporarily store the performance operating element designation information and manipulation information which are output from any of the performance operating elements 1*a*, generate a MIDI signal (note on/off event) based on the performance operating element designation information and the manipulation information, and output the generated MIDI signal to the MIDI signal input unit 2*a* of the electronic musical apparatus 2.

The control operating elements 1*c* correspond to the control operating elements 102 and the detection circuit 104 in FIG. 1. When the user manipulates any of the control operating elements 102, a corresponding control operating element 1*c* generates a control signal representing a type of the manipulated control operating element 102 and a value of manipulation, and outputs the control signal to the function extension unit 2*b* of the electronic musical apparatus 2.

The template storage unit 1*d* is mainly comprised of the CPU 105, the RAM 107 and the storage unit 109, stores a plurality of templates, and transmits requested templates to the editing unit 2*j* in response to a transmission request from the editing unit 2*j*. When the registration content of any of the templates is edited by the editing unit 2*j*, the template storage unit 1*d* receives the edited template from the editing unit 2*j* and stores it. The template editing is basically performed by the electronic musical apparatus 2 (specifically, by the editing unit 2*j* thereof) in this embodiment, but can be performed in practice by the musical control apparatus 1. The registration content of each template is used in both control processes implemented by respective ones of the control apparatus 1 and the musical apparatus 2 (especially, the function extension unit 2*b*). If some template edited by the control apparatus 1 is currently used in the musical apparatus 2, the edited template is transmitted from the control apparatus 1 to the musical apparatus 2, and the registration content of the template on the side of the apparatus 1 is made coincident with that on the side of the apparatus 2.

Figure 3A:
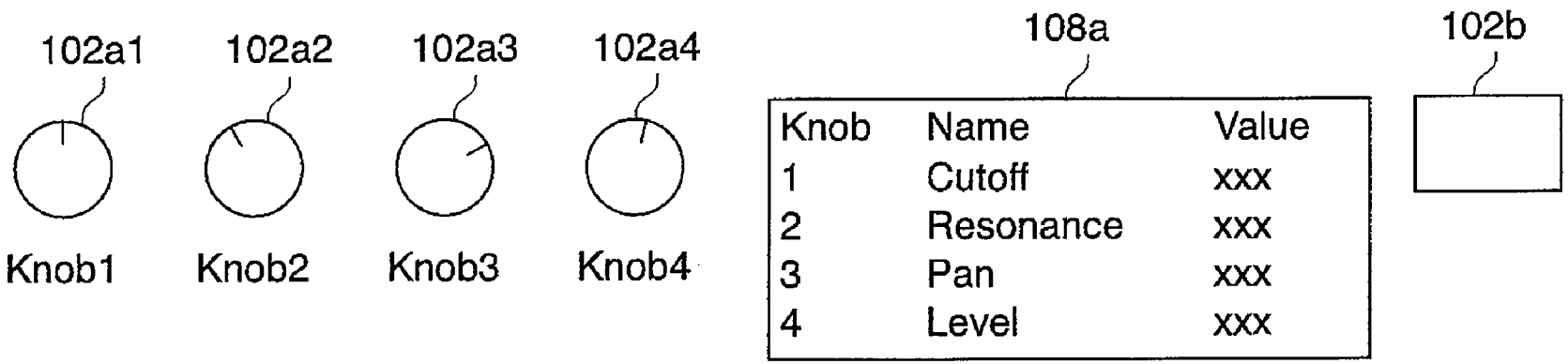
FIG. 3A is a view showing a part of a panel of the musical control apparatus in FIG. 1.
Figure 3B:
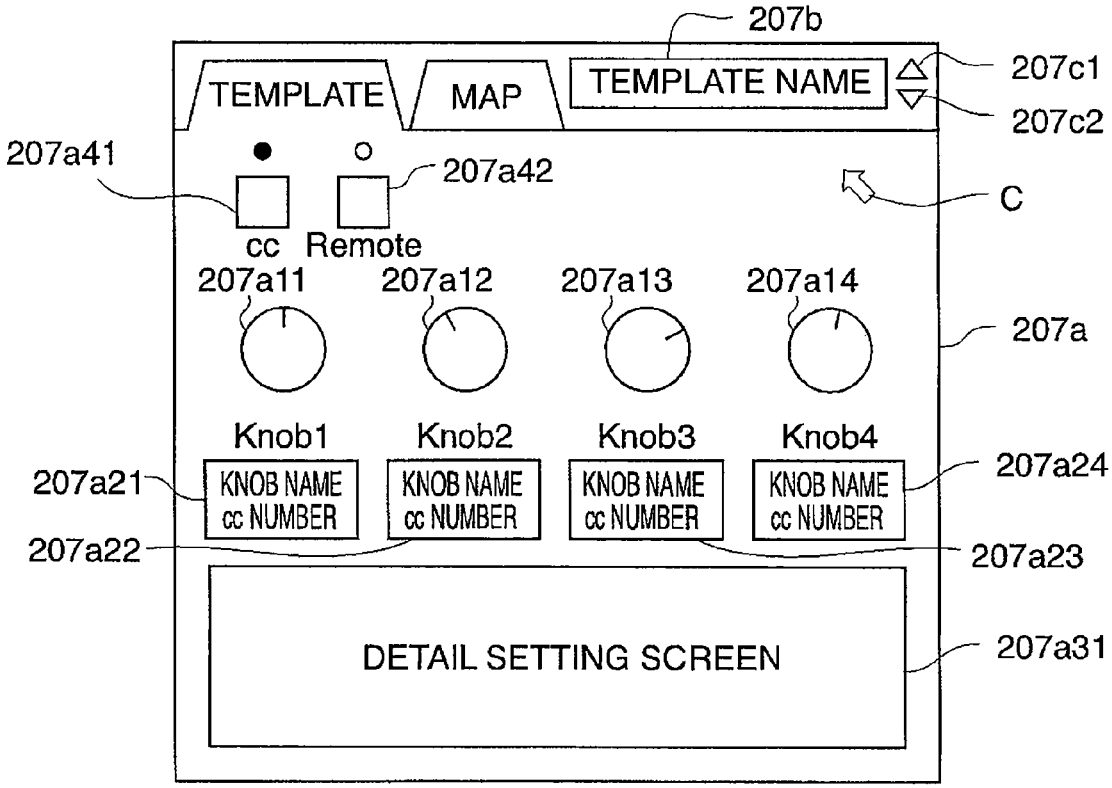
FIG. 3B is a view showing a template setting screen displayed in a user interface unit in FIG. 2.

FIG. 3B shows an example of a template setting screen 207*a* displayed on a user interface unit 2*c*, described later. The settings on each template are performed by the user by inputting setting contents into a detail setting screen 207*a*31 using, e.g., a mouse cursor C and the alphanumeric input keyboard. The setting contents which are input are reflected on the template setting screen 207*a*. In the following, the setting contents of an example template will be described with reference to FIG. 3B.

A plurality of templates stored in the template storage unit 1*d* as described above can be given with their respective names. When a name is given to any of the templates, the name is displayed on a template name display area 207*b*.

The templates in this embodiment are for associating the control operating elements 102 with types of parameters controlled by the operating elements 102. In the illustrated example, a plurality of (e.g., four) knobs 102*a*1 to 102*a*4 among the control operating elements 102 are made to respectively correspond to parameter types. The control operating elements 102 made to correspond to parameter types are not limited to knobs, but may be any other types of operating elements. Since this invention relates to tone generator control, the parameter types registered in the templates are for use in the control of tone generators.

At least selected one or ones of the templates stored in the template storage unit 1*d* are transmitted from the storage unit 1*d* to the function extension unit 2*b*. Based on the contents registered in each of the received templates, the function extension unit 2*b* converts the type of each control operating element 1*c* represented by a control signal therefrom into a parameter type. In this embodiment, as a format of the control signal after conversion, either a MIDI format or a special-purpose format can be selected. If the MIDI format is selected, the control signal is converted into a MIDI control change message. Such a case will be referred to as the cc mode. On the other hand, if the special-purpose format is selected, the control signal is converted into a remote control code, and such a case will be referred to as the remote mode. When the cc mode is selected by clicking a cc button 207*a*41 with the mouse cursor C, the user is able to freely designate a name of each of the control operating elements (in the illustrated example, the knobs 102*a*1 to 102*a*4). When a name of the intended operating element is input into the detail setting screen 207*a*31, the input name is displayed in a display area for the intended operating element (one of display areas 207*a*21 to 207*a*24). When the user further inputs a control change (cc) number representing a parameter type, the cc number is displayed in the same area as the display area where the operating element name is displayed. When the cc mode is selected, a small circle above the cc button 207*a*41 is lit (as shown by black color in the illustrated example). On the other hand, if the remote mode is selected by clicking a remote button 207*a*42 with the mouse cursor C, the user is able to select and set any one of remote control codes, which are prepared in advance. The remote control codes and types of parameters controllable by these codes are already associated with one another. The user makes the intended control operating element (knob in the illustrated example) to correspond to a remote control code, which is capable of controlling the parameter type to be controlled by the intended control operating element. When the control operating element is made to correspond to the remote control code, the name of the remote control code is displayed in the display area for the control operating element (one of the display areas 207*a*21 to 207*a*24). In this embodiment, the names of the remote control codes are fixed and cannot freely be changed by the user. However, the names of these codes may be freely set (or changed) as in the case of the control change messages. The selected either one of the cc mode and the remote mode is set in the template.

When the knobs 102*a*1 to 102*a*4 are made to correspond to the parameter types in terms of the template, knobs, knob names, and parameter values are displayed in association with one another on the display unit 108 of the musical control apparatus 1. FIG. 3A shows part of the panel of the musical control apparatus 1. In the display screen 108*a* of the display unit 108, there is shown an example of how knobs are made to correspond to parameter types. In a case that the parameter value takes any integer value from 0 to 127, it is preferable that the parameter value be displayed in terms of itself or in terms of a deviation from a center value (e.g., 64) of parameter values, depending on parameter type. In this embodiment, the user is able to select a parameter value display range from 0 to 127 or another display range from −64 to +63, and which of the display ranges is selected can be set in the template.

Referring to FIG. 2 again, the display unit 1*e* is mainly comprised of the CPU 105, the RAM 107 and the display unit 108, and is adapted to provide various indications on the display unit 108. For example, as shown in FIG. 3A, there is displayed the display screen 108*a* in which the control operating elements 102 are indicated and control operating element names (or remote control code names) are indicated in association with current parameter values.

The function extension unit 2*b* is mainly comprised of the CPU 204, the RAM 206 and the storage unit 208, receives templates transmitted from the template storage unit 1*d*, and stores the received templates. The function extension unit 2*b* also receives a control signal from each control operating element 1*c*, converts a type of the control operating element represented by the received control signal into a type of parameter based on the registration contents of an associated one of the stored templates, and notifies the user interface unit 2*c* of the parameter type. At this time, the control signal is converted into a MIDI control change message if the cc mode is selected, and into a remote control code if the remote mode is selected. The control signal represents not only the type of control operating element but also a value of manipulation as described above. Nevertheless, the function extension unit 2*b* does not perform any conversion on the manipulation value, and notifies the user interface unit 2*c* of only the type of control operating element, i.e., the type of parameter, because processing on the manipulation value is left to and performed by the user interface unit 2*c*. The function extension unit 2*b* is realized by the CPU 204 by executing function extension software. The function extension software is not ordinarily provided in DAW software, but is newly created to realize this invention. Even when the DAW software is started, therefore, the function extension software that realizes the function extension unit 2*b* is not automatically generated in response to the start-up of the DAW software. In this embodiment, the function extension software is read from the storage unit 208 into the RAM 206 and started upon start of the DAW software.

The user interface unit 2*c* is mainly comprised of the setting operating element 201, the detection circuit 202, the CPU 204, the RAM 206, the storage unit 208 and the display unit 207, and provides a GUI (graphical user interface) environment for the electronic musical apparatus 2. Specifically, the user interface unit 2*c* performs an ordinary control process to accept a manipulation input by the user on the user interface unit 2*c* and give an instruction, which varies according to the manipulation input, to a function block corresponding to the manipulation input. In addition, the user interface unit 2*c* performs a control process to accept via the function extension unit 2*b* a manipulation input by the user using the control operating elements 102 of the musical control apparatus 1 and give an instruction, which varies according to the manipulation input, to a function block corresponding to the manipulation input. The musical control apparatus 1 is therefore able to remotely control various functions of the DAW software.

The tone generator unit 2*d* is mainly comprised of the CPU 204, the ROM 205, the RAM 206 and the storage unit 208, and belongs to a so-called software tone generator for generating a digital audio signal by means of software. The tone generator unit 2*d* includes software tone generators of different types (such as ones generated by different musical tone generating algorithms or ones fabricated by different makers), and uses one or plural tone generators selected therefrom. The tone generator unit 2*d* of this embodiment is comprised of software tone generators alone, but may be comprised of hardware tone generators alone or in combination thereof with software tone generators. In the latter case, software tone generators and hardware tone generators may separately be presented, or mixedly be presented to the user (i.e., in a way not to be separately recognized by the user).

The MIDI signal input unit 2*a* is mainly comprised of the CPU 204 and the RAM 206, and inputs and temporarily stores a MIDI signal from the MIDI signal output unit 1*b*, and supplies it to the sequencer 2*e*.

The sequencer 2*e* is mainly comprised of the CPU 204, the ROM 205, the RAM 206 and the storage unit 208, records an input MIDI signal into a MIDI signal recording region, if a MIDI signal recording mode is selected. If a MIDI signal through mode is selected, the input MIDI signal is output to the tone generator unit 2*d* without or after being recorded in the MIDI signal recording region. Since the MIDI signal recording region of this embodiment is formed by a plurality of tracks, the input MIDI signal is recorded in one of the tracks. Usually, into which of the tracks a MIDI signal is to be recorded is determined in accordance with a MIDI channel contained in the MIDI signal. To this end, each track is set with a MIDI channel, and a MIDI signal input into the sequencer 2*e* is recorded in the track set with the same MIDI channel as that contained in the input MIDI signal. MIDI signals recorded in the MIDI signal recording region are played back by the sequencer 2*e* on a track basis in accordance with a user's playback instruction. In the sequencer 2*e*, types of tone generators for use when tracks are played back can be set on a track basis. Each tone generator can be made to correspond to one of the templates stored in the template storage unit 1*d*. The user is therefore able to cause the sequencer 2*e* to play back MIDI signals using different types of tone generators between the tracks. By properly setting the templates, the user is able to control the parameter, which is different between different tone generators, using the same operating element. The played back MIDI signal is output from the sequencer 2*e* to the tone generator unit 2*d*. The tone generator unit 2*d* generates a digital audio signal based on the MIDI signal, and outputs the generated audio signal to the mixer 2*h*.

The mixer 2*h* is mainly comprised of the CPU 204, the ROM 205, the RAM 206 and the storage unit 208, mixes a digital audio signal from the tone generator unit 2*d* with that from the recorder 2*g*, and outputs the mixed signal to the sound system 2*i*.

The recorder 2*g* is mainly comprised of the CPU 204, the ROM 205, the RAM 206 and the storage unit 208, and records a digital audio signal, which is input from an audio signal input unit 2*f*. In accordance with a user's playback instruction, the recorder 2*g* plays back the recorded digital audio signal, and outputs the played-back digital audio signal to the mixer 2*h*. The recorder 2*g* is also able to record a digital audio signal, which is generated by the tone generator unit 2*d* and supplied therefrom to the recorder 2*g*. When a digital audio signal generated by the tone generator unit 2*d* based on a MIDI signal from the sequencer 2*e* is mixed by the mixer 2*h* with a digital audio signal played back by the recorder 2*g*, the recorder 2*g* plays back the audio signal in synchronism of the playback of the MIDI signal by the sequencer 2*e*.

The sound system 2*i* corresponding to the CODEC 210 and the sound system 211 in FIG. 1 converts a digital audio signal from the mixer 2*h* (after being expanded in the case of a compressed digital audio signal) into an analog audio signal, and converts the analog audio signal into sound.

The editing unit 2*j* is mainly comprised of the CPU 204, the RAM 206 and the storage unit 208, sets templates, and makes each of the templates to correspond to a desired tone generator.

The outline of a control process implemented by the electronic musical system constructed as described above will be described with reference to FIGS. 3A to 5B, and the details of the control process will be described with reference to FIGS. 6 to 8.

The electronic musical system of this embodiment is comprised of the musical control apparatus 1 including the plural control operating elements 102, and the electronic musical apparatus 2 including the tone generator unit 2*d* having plural tone generators and the sequencer 2*e* having plural tracks. This system is configured that various functions of the electronic musical apparatus 2 can remotely be controlled by the user by operating the control operating elements 102 of the musical control apparatus 1.

Figure 4A:
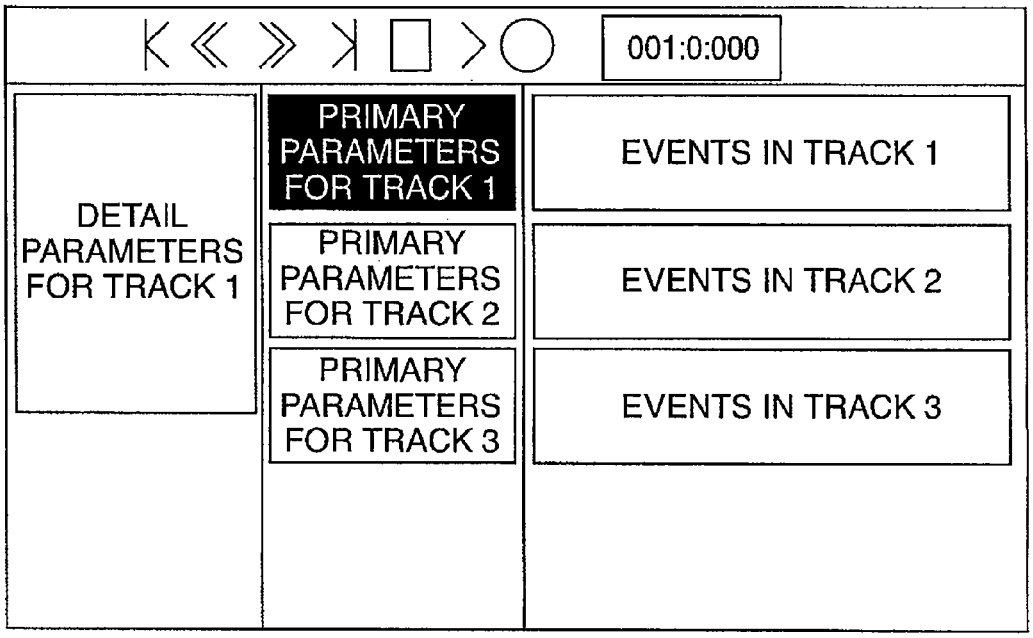
FIGS. 4A and 4B are views for explaining a method for making a tone generator control screen active.
Figure 5A:
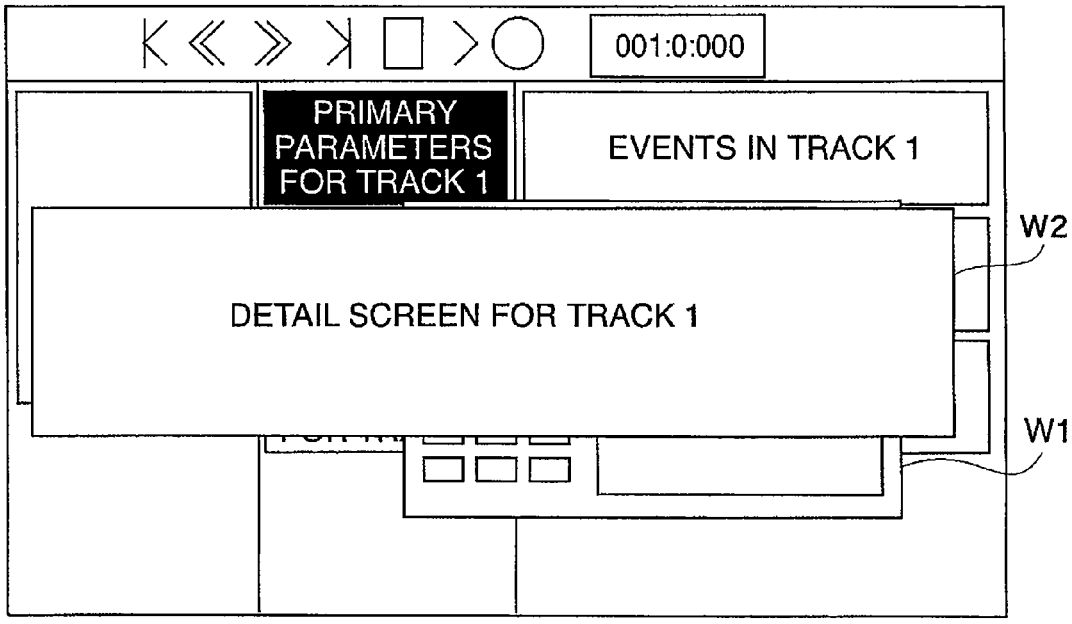
FIGS. 5A and 5B are view for explaining a method for making the tone generator control screen active in a state of screen different from that of FIGS. 4A and 4B.

On the side of the electronic musical apparatus 2, each track of the sequencer 2*e* can be made to correspond to an arbitrary one of the tone generators in accordance with a user's setting manipulation. By defining the correspondence between the tracks and the tone generators, MIDI signals (MIDI events) can be played back by means of tone generators of types different between the tracks. FIG. 4A shows an example sequencer screen displayed on the display unit 207 when a sequencer mode in which the sequencer 2*e* is usable is selected. The user is able to designate an intended track by clicking, with for example a mouse cursor (not shown), a major parameter display field for the n-th track in the sequencer screen (in the illustrated example, n is equal to any one of integer values of 1 to 3). The major parameter display field for the currently designated track is highlighted (in the illustrated example, the highlighting is represented by hatching). How the major parameter display field for the currently designated track is indicated is not limited to being highlighted, but may be any form capable of distinguishing the currently designated track from the tracks which are not currently designated. When the user depresses a right button (not shown) of the mouse in a state the intended track is designated, a pull-down menu is displayed. The pull-down menu includes a "detail screen display" item for displaying a detail screen. When the user selects the "detail screen display" item with the mouse cursor, a detail screen for the currently designated track is made active as shown in FIG. 5A. The detail screen includes a tone generator setting field for making settings on the tone generator concerned. The user is therefore able to assign a desired tone generator to the currently designated track by selecting, with the mouse or the alphanumeric input keyboard, one of the tone generators of the electronic musical apparatus 2 and inputting the selected tone generator into the tone generator setting field.

Figure 3C:
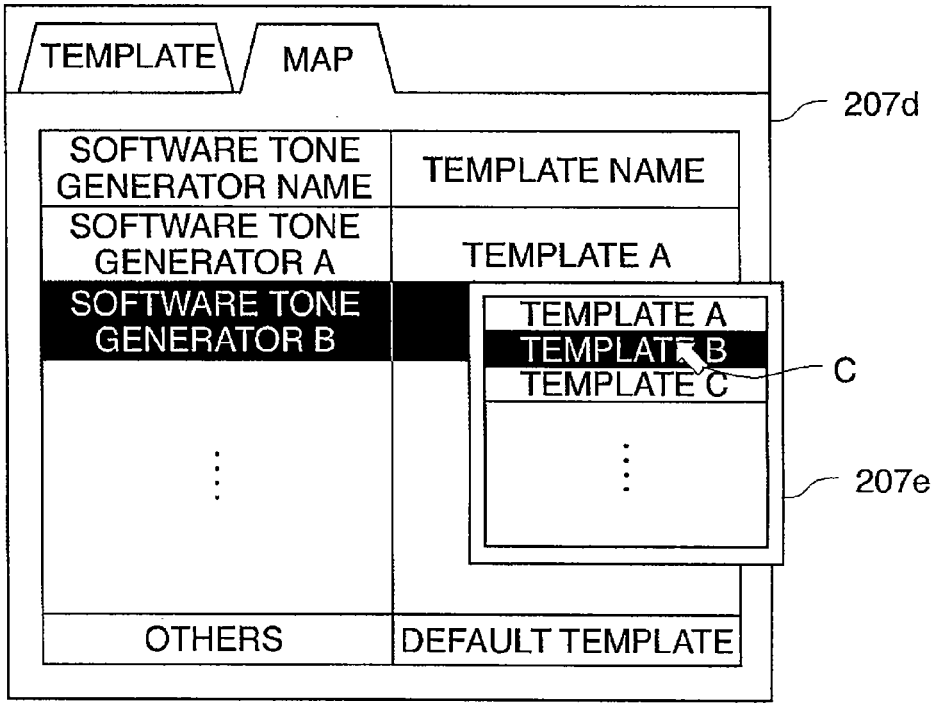
FIG. 3C is a view showing an example of a map setting screen.
Figure 4B:
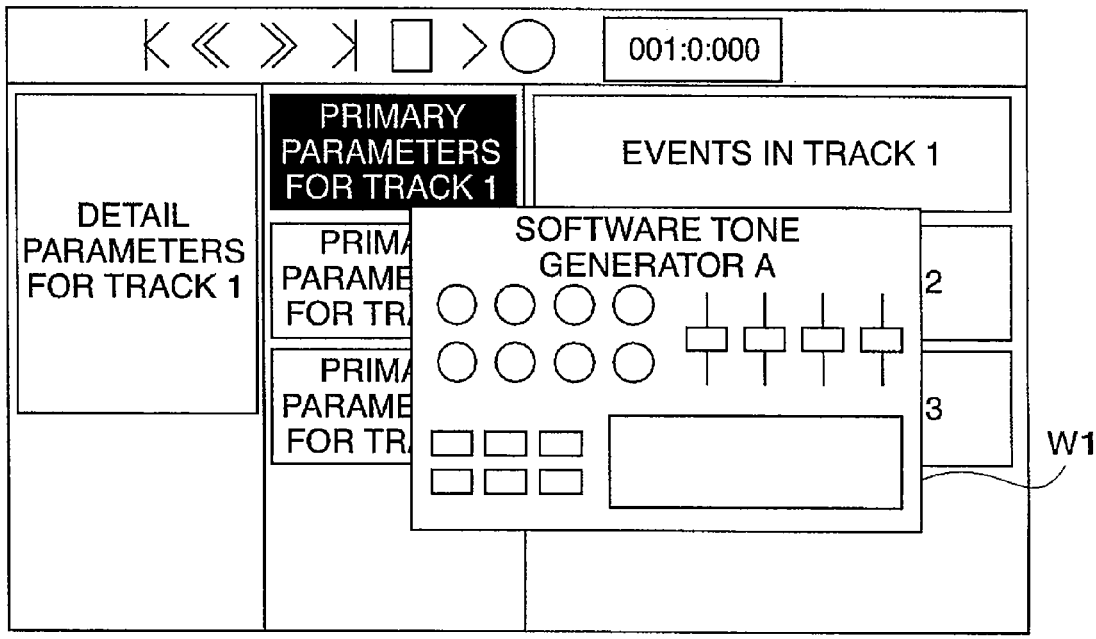
Figure 5B:
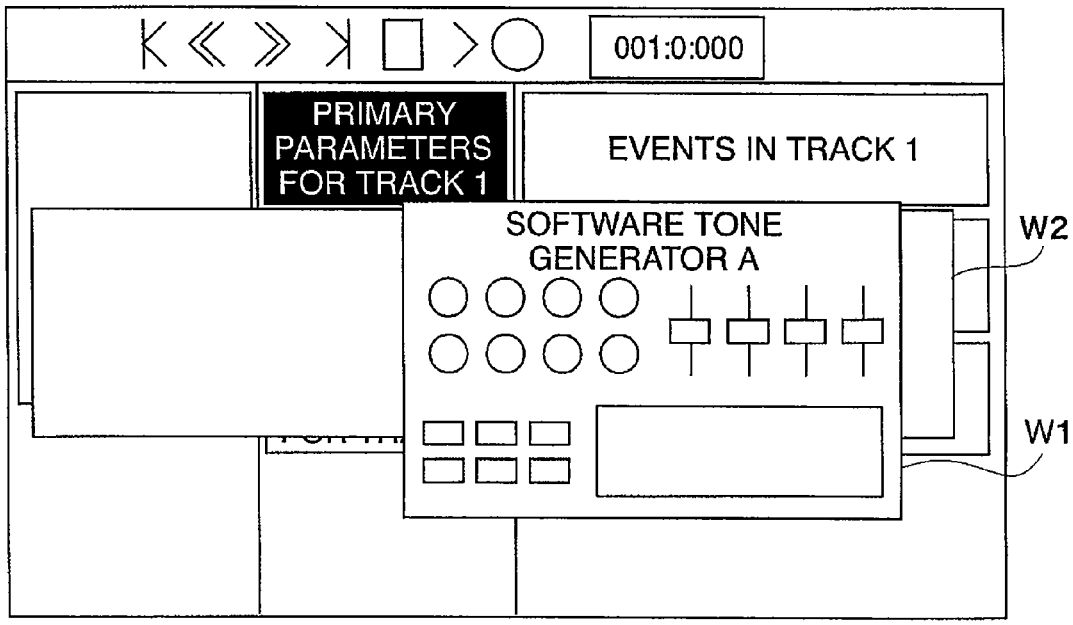

The user is able to cause the sequencer screen to display thereon a tone generator control screen window W1 shown in FIG. 4B or 5B for the tone generator assigned to the track, and set tone generator parameters of the tone generator via the window W1. In the illustrated example, operating elements for setting the tone generator parameters are displayed in the window W1. The user can directly manipulate a desired operating element with the mouse cursor and set a tone generator parameter assigned to the operating element. In the settings of the tone generator parameters of the tone generators assigned to the respective tracks, according to one of features of this invention, setting contents are not input via the tone generator control screen window W1, but are input using the control operating elements 102 of the musical control apparatus 1. To this end, there are prepared in advance a plurality of templates in which the control operating elements 102 are made to correspond to respective ones of tone generator parameters controlled by the operating elements 102. As shown in FIG. 3C, each tone generator is made in one-to-one correspondence with any of the templates. Tone generator parameters of the tone generator assigned to the currently designated track are set by the user by manipulating the corresponding control operating elements 102 of the musical control apparatus 1.

As described above, the user is able to set the tone generator parameters of the tone generator assigned to the currently designated track, without performing an input manipulation directly on the tone generator control screen window W1. In the setting of tone generator parameters, however, it is also convenient for the user to be allowed to make a direct input to the window W1 in a state the window W1 is made active so as to be displayed uppermost among plural windows displayed one upon another on the display unit 207. This is because, in that case, a setting result is immediately reflected on the window W1 when the user sets an intended tone generator parameter by manipulating the corresponding control operating element 102. By watching a display state on the window W1, the user is able to confirm, as needed, the setting result of the tone generator parameter attained by the user's manipulation on the control operating element 102. To make the window W1 active, there may be a method in which the window W1 is made active as shown in FIG. 4B when the user clicks, with the mouse cursor, a tone generator control screen display button (not shown) displayed in the detail parameter display field for the track 1 in a state that the track (in the illustrated example, track 1) is designated as shown in FIG. 4A. However, if the detail parameter display field for the track 1 is hidden by another window (i.e., a detail screen window W2 for the track 1) as shown in FIG. 5A, the tone generator control screen display button is not visible from the user. In that case, the user is required to extinguish or temporarily hide the window W2 to make the detail parameter display field to be visible, and then click the screen display button in the display field. Thus, the tone generator parameter can be set from the musical control apparatus 1, however, the user must move the hand from the control apparatus 1 to the musical apparatus 2 to make the window W1 active, and the user's music production is discontinued. To obviate this, as shown in FIG. 3A, a tone generator control screen display button 102*b* is provided in the control operating elements 102 of the control apparatus 1, and the window W1 for the tone generator assigned to the currently designated track is made active when the user depresses the button 102*b*. With this arrangement, the user is able to perform, on the control apparatus 1, both the setting of tone generator parameters of the tone generator assigned to the currently designated track and the control of display of the window W1 for that tone generator, without discontinuing the user's music production.

When the button 102*b* is depressed by the user in a state that the window W1 is made active, the window W1 is closed.

In this embodiment, each track of the sequencer 2*e* is designated on the sequencer screen by using the mouse or the alphanumeric input keyboard as described above. That is, the track is not designated on the control apparatus 1 but is designated on the musical apparatus 2. This is not limitative. Specifically, a button, similar to the button 102*b*, to designate a track of the sequencer 2*e* may be provided on the control apparatus 1 for being depressed by the user to designate an intended track.

Next, the control process will be described in detail.

Figure 6:
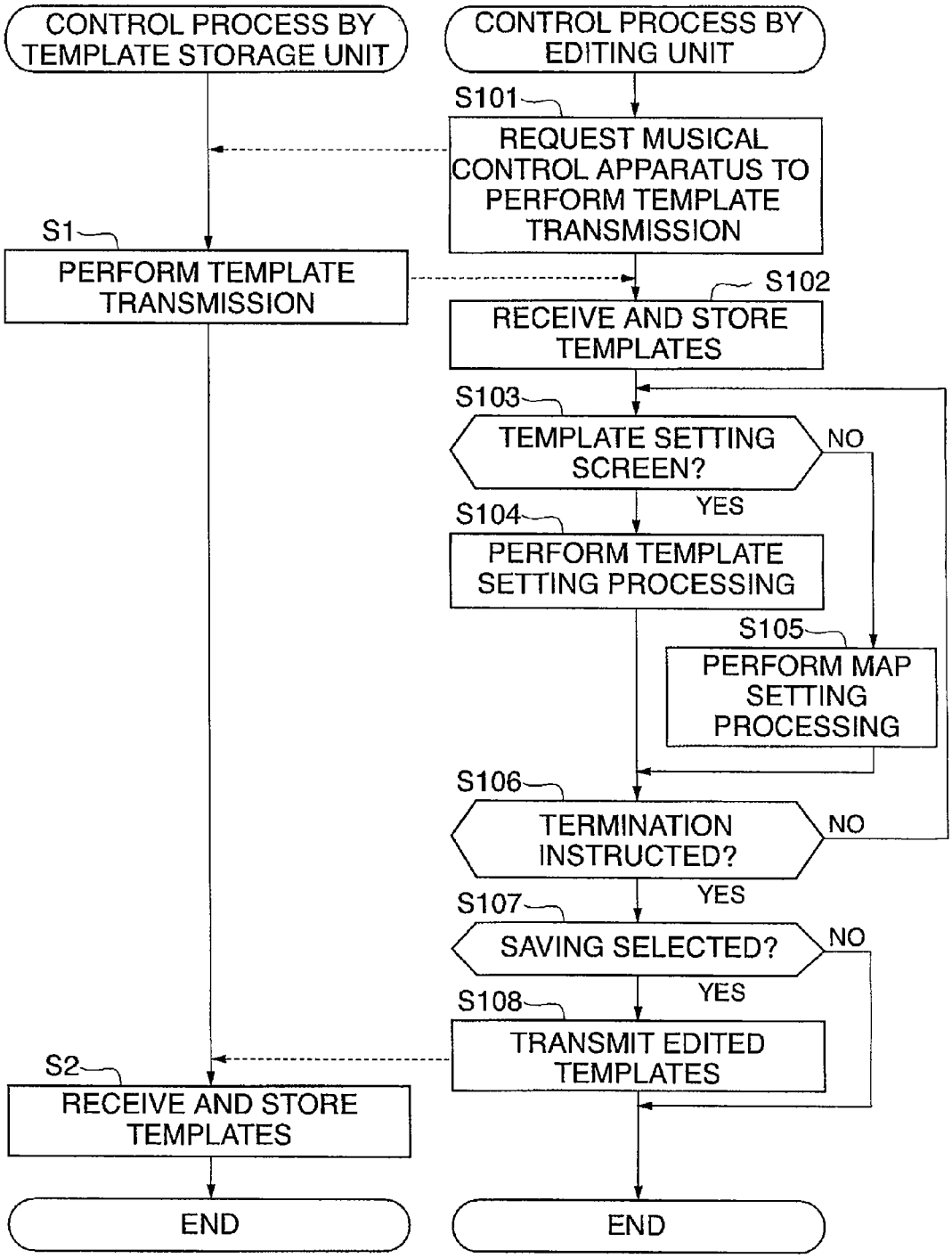
FIG. 6 is a flowchart showing the procedure of a control process implemented by a CPU of an editing unit of the electronic musical apparatus in FIG. 1.

FIG. 6 shows in flowchart the procedures of the control process implemented by the editing unit 2*j* of the musical apparatus 2, especially by the CPU 204 thereof. The control process is mainly comprised of the following processing (1) to (4).

(1) Template acquisition processing (steps S101 and S102)

(2) Template setting processing (step S104)

(3) Map setting processing (step S105)

(4) Termination processing (steps S106 to S108)

Since the templates are stored in the template storage unit 1*d* of the musical control apparatus 1 as mentioned above, processing to exchange templates between the editing unit 2*j* and the template storage unit 1*d* is included in the flowchart in FIG. 6.

When an instruction to cause the editing unit 2*j* to start the control process is given by the user using, e.g., the mouse or the alphanumeric input keyboard of the setting operating element 201, the CPU 204 proceeds the process to the template acquisition processing. In the template acquisition processing, the CPU 204 first sends a template transmission request to the template storage unit 1*d* of the musical control apparatus 1. In response to this, the template storage unit 1*d* performs template transmission (step S1). On the musical apparatus 2, a particular type of DAW software is not always installed and runs, but one selected from many types of DAW software is installed and runs. Alternatively, plural types of DAW software are installed and one selected therefrom runs on the musical apparatus 2. Usually, a plurality of templates for each DAW software are stored in the template storage unit 1*d*. Upon receipt of the template transmission request from the editing unit 2*j*, the template storage unit 1*d* therefore transmits to the editing unit 2*j* plural templates prepared for the DAW software currently running on the musical apparatus 2. To this end, the template storage unit 1*d* must know which of the DAW software currently runs on the apparatus 2. As a method for notifying the template storage unit 1*d* of which of the DAW software currently runs, there may be for example a method in which information identifying the DAW software currently running is transmitted from the editing unit 2*j* to the control apparatus 1 along with the template transmission request. It should be noted that a map is sometimes stored in the template storage unit 1*d* in association with templates. In that case, the template storage unit 1*d* transmits the map associated with the templates to the editing unit 2*j* along with the templates.

When receiving templates from the template storage unit 1*d*, the editing unit 2*j* causes the received templates to be stored, e.g., in a template storage region (not shown) in the RAM 206 (step S102). When the map is transmitted from the template storage unit 1*d*, the editing unit 2*j* stores the map into, e.g., a map storage region (not shown) in the RAM 206. In a case that the templates requested by the editing unit 2*j* are not stored in the template storage unit 1*d*, the unit 1*d* does not transmit the templates, and the templates are entirely created by the editing unit 2*j*.

When the user instructs the editing unit 2*j* to display a template setting screen on the display unit 207, the CPU 204 proceeds the process to the template setting processing (step S103→step S104). In the setting process, the CPU 204 displays a template setting screen as shown in FIG. 3B. At that time, one of the templates stored in the template storage region is selected, and the template setting screen is displayed in accordance with the content registered in the selected template. To display a different template setting screen, the user manipulates an up/down button 207*c*1 or 207*c*2 to designate another template. As described previously, the name of the currently designated template is displayed in the template name display area 207*b*. Since how the registration content of the template is input into or edited on the template setting screen is described previously, a description thereof is omitted.

When the user instructs the editing unit 2*j* to display a map setting screen on the display unit 207, the CPU 204 proceeds the process to the map setting processing (step S103→step S105). A map is for making tone generators to correspond to templates. In the map setting processing, the CPU 204 displays a map setting screen 207*d* as shown in FIG. 3C. If a map is stored in the map storage region, the CPU 204 reads out the map therefrom and displays the map setting screen based on the map. Next, the CPU 204 makes tone generators to correspond to templates in accordance with a user's manipulation. To this end, the CPU 204 finds all the tone generators provided (or installed) in the musical apparatus 2, and displays the names of all the tone generators in a "software tone generator name" column. In this embodiment, all the tone generators in the apparatus 2 are automatically listed in the map. When the user designates with the mouse cursor C any of the tone generators in the map (in the illustrated example, software tone generator B) and depresses the right button of the mouse in a state the mouse cursor C is positioned to a "template name" column adjacent to the "software tone generator name" column, a template name list window 207*e* is displayed in which names of selectable templates are indicated in the form of a list. When the user selects, with the mouse cursor C, any of the template names from the template name list window 207*e* (in the example, template B), the selected template name is displayed on the lateral side of the designated tone generator name, whereby the tone generator is made to correspond to the template. In some cases, due to a new software tone generator being installed in the musical apparatus 2 after the map is set or due to carelessness by the user or the like, a proper template is not made to correspond to a tone generator whose name is indicated in the "software tone generator name" column in the map. In such a case, a tone generator to which no template is made to correspond is assigned to any of the tracks of the sequencer 2*e*. In that case, tone generator parameters of the tone generator assigned to that track cannot be set by using the control operating elements 102 of the control apparatus 1. To address this problem, a default template is provided. When some tone generator to which no template is made to correspond is assigned to any of the tracks of the sequencer 2*e* and that track is designated by the user, the default template is automatically made to correspond to that tone generator, and tone generator parameters of this tone generator are set by using the control operating elements 102 based on the registration content of the default template. The default template is registered with a correspondence between primary ones of the control operating elements 102 and ordinary tone generator parameters of an ordinary tone generator.

In the "software tone generator name" column of the map in this embodiment, all the tone generators in the musical apparatus 2 are automatically listed, but this is not limitative. There may only be listed ones selected by the user from among the tone generators of the apparatus 2. In that case, tone generator names are selected in the "software tone generator name" column of the map by using the same method as the above described method for selection of template names.

The execution of the template setting processing or the map setting processing is continued until a termination instruction is given by the user. When the termination instruction is given, the CPU 204 proceeds the process to the termination processing (step S106→step S107). In the termination processing, the CPU 204 inquires of the user about whether or not edited templates are to be saved, and if the user selects the saving, transmits the edited templates to the control apparatus 1 (step S107→step S108). On the other hand, if the saving is not selected by the user, nothing is done and the control process is completed (step S107→end). When the edited templates are transmitted to the control apparatus 1 in the step S108, the map is transmitted to the apparatus 1 together with the edited templates, if the map is set (or edited). When the template setting processing is not carried out, the CPU 204 may immediately complete the control process when the completion is instructed by the user, without inquiring of the user about whether the saving is to be made in the step S107. When receiving the edited templates from the editing unit 2*j*, the template storage unit 1*d* of the control apparatus 1 stores the received templates (step S2). If the map is transmitted from the editing unit 2*j* together with the templates, the template storage unit 1*d* also stores the map.

Figure 7:
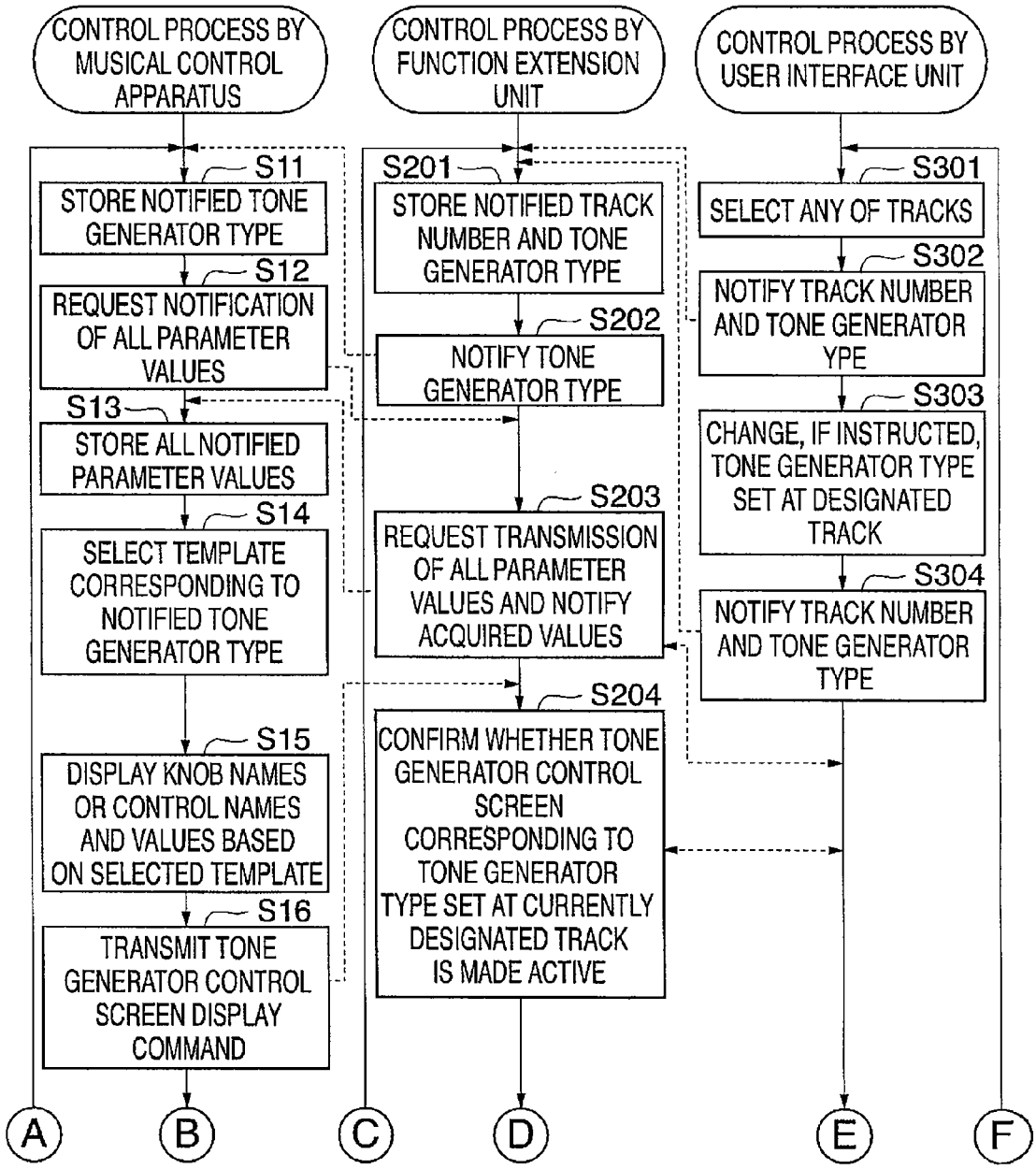
FIG. 7 is a flowchart showing the procedures of control processes respectively implemented by CPUs of the musical control apparatus and the electronic musical apparatus in FIG. 1.
Figure 8:
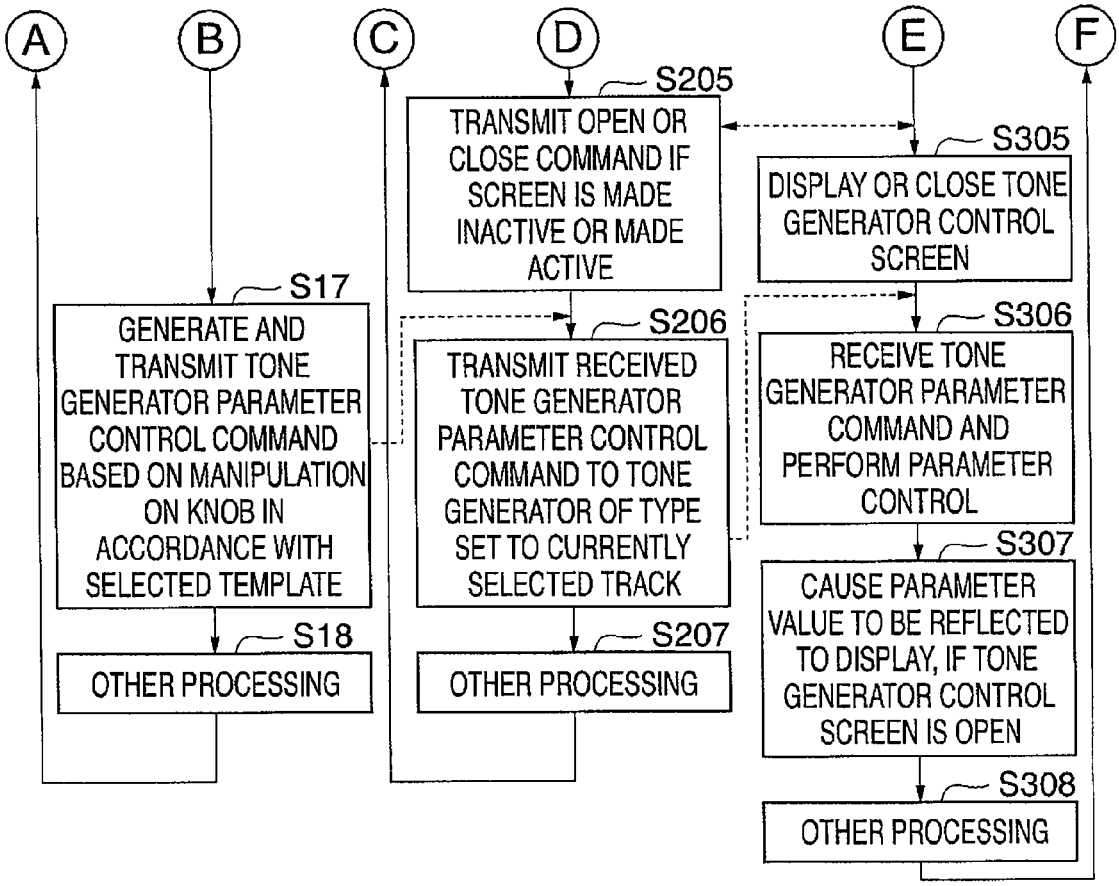
FIG. 8 is a flowchart showing the procedures that follows the control processes in FIG. 7.

FIGS. 7 and 8 show in flowchart the procedures of control processes respectively implemented by the musical control apparatus 1 and the electronic musical apparatus 2, especially by the CPUs 105 and 204 thereof. The control process to be implemented by the apparatus 2 is carried out by the function extension unit 2*b* and the user interface unit 2*c* in the functional arrangement in FIG. 2. Thus, the control processes executed by these units 2*b*, 2*c* are shown in FIGS. 7 and 8.

The user interface unit 2*c* mainly carries out the following processing (21) to (24).

(21) Tone generator typesetting processing to set (assign) a tone generator type to a track of the sequencer 2*e* (steps S301 to S304)

(22) Display control processing to or not to display a tone generator control screen (the window W1 in FIGS. 4 and 5) on the display unit 207 (step S305)

(23) Tone generator parameter control processing to actually control a tone generator parameter (steps S306 and S307)

(24) Other processing (step S308)

The function extension unit 2*b* mainly performs a function of exchanging data between the musical control apparatus 1 and the user interface unit 2*c*.

The control apparatus 1 mainly carries out the following processing (31) to (36).

(31) Tone generator parameter value acquisition processing to acquire present values of all the tone generator parameters of the tone generator whose tone generator type is set in the tone generator type setting processing (steps S11 to S13)

(32) Template selection processing to select a template for the tone generator whose type is set in the tone generator type setting processing (step S14)

(33) Display processing to display a display screen on the display unit 108 (step S15)

(34) Tone generator control screen display button manipulation processing performed when the button 102*b* is manipulated by the user (step S16)

(35) Knob manipulation processing performed when one of the knobs 102*a*1 to 102*a*4 in FIG. 3A is manipulated by the user (step S17)

(36) Other processing (step S18)

When the user instructs the user interface unit 2*c* to shift to the sequencer mode, the CPU 204 shifts the operation mode of the musical apparatus 2 to the sequencer mode, and proceeds the process to the tone generator type setting processing. In this setting processing, the CPU 204 first displays the sequence screen in FIG. 4A on the display unit 207, and waits for a user's track selection designation. When the user selectively designates any of the tracks of the sequencer 2*e* using the mouse cursor, the CPU 204 acquires a track number of the selectively designated track, and temporarily stores the track number into a work area (not shown) in the RAM 206 (step S301). Next, the CPU 204 acquires a type (e.g., a name) of the tone generator assigned to the selectively designated track, and notifies the function extension unit 2*b* of the track number of that track and the tone generator type of the tone generator assigned to the track (step S302). If no tone generator is assigned to the selectively designated track, the CPU 204 notifies the user, using visual display, voice, etc., that the tone generator is not assigned as yet. In response to this, when the user assigns any of the tone generators of the musical apparatus 2 to the selectively designated track as previously described, the CPU 204 notifies the function extension unit 2*b* of the track number of the selectively designated track and the type of the tone generator assigned to that track. When the track number and the tone generator type are notified from the user interface unit 2*c*, the function extension unit 2*b* stores the track number and the tone generator type into a track number/tone generator type storage region (not shown) of the RAM 206 (step S201), and notifies the control apparatus 1 of the tone generator type (step S202).

When notified of the tone generator type from the function extension unit 2*b*, the CPU 105 of the control apparatus 1 proceeds the process to the tone generator parameter value acquisition processing. In this acquisition processing, the CPU 105 first stores the notified tone generator type into a tone generator type storage area (not shown) in the RAM 107 (step S11). Next, the CPU 105 requests the function extension unit 2*b* to notify values of all the tone generator parameters of the tone generator of that type (step S12). In response to this, the function extension unit 2*b* requests the user interface unit 2*c* to inform values of all the tone generator parameters and waits for a response from the user interface unit 2*c* (step S203). When the user interface unit 2*c* acquires the values of all the tone generator parameters of the intended tone generator from that tone generator and notifies the function extension unit 2*b* of these values, the unit 2*b* acquires the notified values of all the tone generator parameters and notifies the control apparatus 1 of those values (step S203). The CPU 105 of the control apparatus 1 stores the notified values of all the tone generator parameters into the tone generator parameter storage region (not shown) of the RAM 107 (step S13).

On the other hand, if the user gives the user interface unit 2*c* an instruction to change the tone generator type set at the selectively designated track, the tone generator type set at that track is changed to an instructed tone generator type, whereby the tone generator type stored in the track number/tone generator type storage region is renewed (step S303). Subsequently, as in the case of step S302, the track number of that track and the changed tone generator type are notified to the function extension unit 2*b* (step S304). In response to this, the unit 2*b* and the control apparatus 1 execute the same processing as those executed by them in response to the track number and the tone generator type being notified in the step S302. A description thereof is omitted.

As explained above, when the user simply gives an instruction for selection of track, the tone generator type concerned is notified by the user interface unit 2*c* via the function extension unit 2*b* to the control apparatus 1, even if neither a new tone generator is assigned to a track, nor a tone generator assigned to a track is changed to another tone generator. This is intended that each time selection of track is instructed on the musical apparatus 2, the control apparatus 1 is allowed to acquire the latest values of all the tone generator parameters of the tone generator corresponding to the selected track, and the latest values are reflected to the display screen 108*a* (see FIG. 3A) of the display unit 108.

Next, the CPU 105 of the control apparatus 1 proceeds the process to the template selection processing. In the template selection processing, the CPU 105 selects a template corresponding to the notified tone generator type based on the stored map (step S14). If there is not present a template corresponding to the notified tone generator type, the default template is selected as previously described (step S14).

Next, the CPU 105 of the control apparatus 1 proceeds the process to the display processing. In the display processing, based on the selected template and all the stored tone generator parameters, the CPU 105 displays knob names and values or control names and values on the display screen 108*a* as shown in FIG. 3A (step S15). In the illustrated example, knob names and values are displayed on the display screen 108*a*.

When the user depresses the tone generator control screen display button 102*b* on the panel of the control apparatus 1, the CPU 105 of the apparatus 1 proceeds the process to the tone generator control screen display button manipulation processing. In this manipulation processing, the CPU 105 transmits a tone generator control screen display command to the musical apparatus 2 (step S16). The function extension unit 2*b* of the apparatus 2 receives that command from the control apparatus 1 and determines whether or not the tone generator control screen corresponding to the tone generator type set at the track number of the track currently designated by the user is made active (step S204). If it is determined that the tone generator control screen is made active, a command to close the screen is transmitted to the user interface unit 2*c*. On the other hand, if it is determined that the screen is made inactive, a command to open the screen is transmitted to the unit 2*c* (step S205). When receiving the open or close command, the user interface unit 2*c* proceeds the process to the display control processing, and opens or closes the tone generator control screen in accordance with the received command (step S305).

When the user manipulates any of the knobs 102*a*1 to 102*a*4, the CPU 105 of the control apparatus 1 proceeds the process to the knob manipulation processing. In this knob manipulation processing, the CPU 105 generates a tone generator parameter control command based on a type of the manipulated knob and an amount of manipulation in accordance with the template selected in the step S14 (i.e., the template made to correspond to the tone generator assigned to the currently designated track), and transmits the generated command to the musical apparatus 2 (step S17). The tone generator parameter control command is generated in the form of a MIDI control change message when the cc mode is selected, and generated in the form of a dedicated remote control command when the remote mode is selected. The function extension unit 2*b* of the musical apparatus 2 receives the tone generator parameter control command from the control apparatus 1, and transmits via the user interface unit 2*c* the received command to the tone generator of a type that is set (assigned) to the currently selected track (step S206). The user interface unit 2*c* receives the tone generator parameter control command, and based thereon, controls a corresponding tone generator parameter of a corresponding tone generator (step S306). If the tone generator control screen is open (made active), the user interface unit 2*c* causes a value of the controlled tone generator parameter to be reflected to the display (step S307). It should be noted that other processing is performed in each of steps S18, S207 and S308.

In this embodiment, the DAW software does not include the function extension software that realizes the function extension unit 2*b*, but this is not limitative. The DAW software may be created to include the function extension software. DAW software having functions equivalent to those of the function extension unit 2*b* may also be created.

In this embodiment, the function extension unit 2*b* is disposed on the electronic musical apparatus 2, but may be disposed on the musical control apparatus 1.

It is to be understood that the present invention may also be accomplished by supplying a system or an apparatus with a storage medium in which a program code of software, which realizes the functions of the above described embodiment is stored and by causing a computer (or CPU or MPU) of the system or apparatus to read out and execute the program code stored in the storage medium.

In that case, the program code itself read from the storage medium realizes the functions of the above described embodiment, and therefore the program code and the storage medium in which the program code is stored constitute the present invention.

Examples of the storage medium for supplying the program code include a flexible disk, a hard disk, and a magnetic-optical disk, a CD-ROM, a CD-R, a CD-RW, a DVD-ROM, a DVD-RAM, a DVD-RW, a DVD+RW, a magnetic tape, a nonvolatile memory card, and a ROM. The program code may be supplied from a server computer via a communication network.

Further, it is to be understood that the functions of the above described embodiment may be accomplished not only by executing the program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

What is claimed is:

1. An electronic musical system comprised of an electronic musical apparatus and a musical control apparatus for remotely controlling the electronic musical apparatus, wherein:

the musical control apparatus comprises:

at least one operating element each adapted to vary a parameter;

a receiver unit adapted to receive tone generator type information representing a tone generator type from the electronic musical apparatus; and a transmission unit adapted, in response to a user's manipulation on said operating element, to transmit to the electronic musical apparatus a parameter control command for controlling a tone generator parameter of a tone generator of the type represented by the tone generator type information received by said receiver unit, and the electronic musical apparatus comprises:

a sequencer having a plurality of tracks;

tone generators of different tone generator types;

a designation unit adapted to designate any one of the plurality of tracks;

a setting unit adapted to set tone generator types each selected from the different tone generator types to respective ones of the tracks;

a transmission unit adapted, when any one of the tracks is designated by said designation unit, to transmit to the musical control apparatus tone generator type information representing the tone generator type set by said setting unit to the designated track;

a receiver unit adapted to receive the parameter control command transmitted from the musical control apparatus; and a control unit adapted to control, in accordance with the parameter control command received by said receiver unit of the electronic musical apparatus, the tone generator parameter of the tone generator of the type set to the designated track.

2. The electronic musical system according to claim 1, wherein the musical control apparatus further includes a display unit adapted to display a name corresponding to the parameter control command.

3. The electronic musical system according to claim 1, wherein said operating element of the musical control apparatus includes parameter control operating elements, and said tone generators of the electronic musical apparatus each comprise tone generator parameters, and the musical control apparatus further includes:

a storage unit adapted to store a plurality of templates in each of which a correspondence relation between the parameter control operating elements and the tone generator parameters of one of said tone generators is defined, said storage unit being adapted to store a correspondence table in which each of at least one of said tone generators is made to correspond to any template selected from the templates stored in said storage unit;

a selection unit adapted to read out from said storage unit the template which is made to correspond to the tone generator of the type represented by the tone generator type information received by said receiver unit of the musical control apparatus and select the read-out template; and a generation unit adapted to generate the parameter control command based on a user's manipulation on any one of the parameter control operating elements and the template selected by said selection unit, and said transmission unit is adapted to transmit the parameter control command generated by said generation unit to the electronic musical apparatus.

4. The electronic musical system according to claim 3, wherein the electronic musical apparatus further includes a correspondence table setting unit adapted to set the correspondence table in response to a user's setting operation.

5. The electronic musical system according to claim 3, wherein said storage unit of the musical control apparatus is adapted to store a default template, and said selection unit of the musical control apparatus is adapted to read out the default template from said storage unit and select the read-out default template in a case where the tone generator of the type represented by the tone generator type information received by said receiver unit is not present in the correspondence table.

6. A musical control apparatus for remotely controlling an external electronic musical apparatus, comprising:

at least one operating element each adapted to vary a parameter;

a receiver unit adapted to receive tone generator type information representing a tone generator type from the electronic musical apparatus; and a transmission unit adapted, in response to a user's manipulation on said operating element, to transmit to the electronic musical apparatus a parameter control command for controlling a tone generator parameter of a tone generator of the type represented by the tone generator type information received by said receiver unit.

7. The musical control apparatus according to claim 6, further including:

a display unit adapted to display a name corresponding to the parameter control command.

8. The musical control apparatus according to claim 6, wherein said operating element of the musical control apparatus includes parameter control operating elements, and the electronic musical apparatus includes tone generators each comprising tone generator parameters, and the musical control apparatus further includes:

a storage unit adapted to store a plurality of templates in each of which a correspondence relation between the parameter control operating elements and the tone generator parameters of one of said tone generators is defined, said storage unit being adapted to store a correspondence table in which each of at least one of the tone generators is made to correspond to any template selected from the templates stored in said storage unit;

a selection unit adapted to read out from said storage unit the template which is made to correspond to the tone generator of the type represented by the tone generator type information received by said receiver unit of the musical control apparatus and select the read-out template; and a generation unit adapted to generate the parameter control command based on a user's manipulation on any one of the parameter control operating elements and the template selected by said selection unit, and said transmission unit is adapted to transmit the parameter control command generated by said generation unit to the electronic musical apparatus.

9. The musical control apparatus according to claim 8, wherein the electronic musical apparatus further includes a correspondence table setting unit adapted to set the correspondence table in response to a user's setting operation.

10. The musical control apparatus according to claim 8, wherein said storage unit of the musical control apparatus is adapted to store a default template, and said selection unit of the musical control apparatus is adapted to read out the default template from said storage unit and select the read-out default template in a case where the tone generator of the type represented by the tone generator type information received by said receiver unit is not present in the correspondence table.

11. A control method for controlling an electronic musical apparatus including a sequencer having a plurality of tracks and tone generators of different tone generator types, the control method comprising:

a transmission step of transmitting to the musical control apparatus, when any one of the tracks is designated by a designation unit adapted to designate any one of the plurality of tracks, tone generator type information representing the tone generator type set to the designated track by a setting unit adapted to set tone generator types selected from the different tone generator types to respective ones of the tracks;

a reception step of receiving a parameter control command transmitted from the musical control apparatus; and a control step of controlling, in accordance with the parameter control command received in said reception step, the tone generator parameter of the tone generator of the type set to the designated track.

* * * * *